US005929009A

United States Patent [19]

Gambogi

[11] Patent Number: 5,929,009

[45] Date of Patent: Jul. 27, 1999

[54] LIQUID DETERGENT COMPOSITION CONTAINING AMINE OXIDE

[75] Inventor: Joan Gambogi, Belle Mead, N.J.

[73] Assignee: Colgate Palmolive Co., Piscataway, N.J.

[21] Appl. No.: 09/262,820

[22] Filed: Mar. 5, 1999

Related U.S. Application Data

[63] Continuation-in-part of application No. 09/210,407, Dec. 11, 1998.

[51] Int. Cl.[6] ..... C11D 1/75; C11D 1/835; C11D 1/86; C11D 3/30

[52] U.S. Cl. ..... 510/237; 510/423; 510/433; 510/434; 510/499; 510/531

[58] Field of Search ..... 510/423, 433, 510/434, 499, 531, 237

[56] References Cited

U.S. PATENT DOCUMENTS

| | | | |
|---|---|---|---|
| 4,915,854 | 4/1990 | Mao et al. | 252/8.8 |
| 5,073,274 | 12/1991 | Caswell | 252/8.6 |
| 5,641,480 | 6/1997 | Vermeer | 424/70.24 |

*Primary Examiner*—Yogendra Gupta
*Assistant Examiner*—Gregory R. Delcotto
*Attorney, Agent, or Firm*—Richard E. Nanfeldt

[57] ABSTRACT

A liquid detergent composition with improved color stability comprising an amine oxide, a penta sodium salt of diethylene triamine pentaacetic acid and water.

3 Claims, No Drawings

LIQUID DETERGENT COMPOSITION CONTAINING AMINE OXIDE

RELATED APPLICATION

This application is a continuation in part application of U.S. Ser. No. 9/210,407 filed 12/11/98.

FIELD OF THE INVENTION

The present invention relates to novel light duty liquid detergent compositions containing amine oxide which has improved color stability.

BACKGROUND OF THE INVENTION

There are numerous patents which describe liquid detergent compositions containing an amine oxide surfactant in combination with one or more other surfactants such as nonionic surfactants, anionic surfactants, cationic surfactants and zwitterionic surfactants. Some of these U.S. Pat. Nos. are 4,316,824; 4,435,317; 4,536,317; 4,536,318; 4,663,063; 4,599,188; 4,555,360; 5,118,440; 5,320,783; 5,417,893 and 5,415,814.

A major problem for a liquid detergent composition containing an amine oxide is color stability. Formulas containing amine oxide turn yellow upon aging due to heat or the ultraviolet rays of sunlight. The use of hydroxyethylene diamine tetraacetic acid as a chelant to improve color stability has only been marginally successful.

The present invention teaches that the color stability of a liquid detergent composition containing amine oxides can be dramatically improved by quenching the residual free peroxides in the amine oxide through the addition of the pentasodium salt of diethylene triamine pentaacetic acid to the detergent composition.

U.S. Pat. No. 3,935,129 discloses a liquid cleaning composition based on the alkali metal silicate content and containing five basic ingredients, amely, urea, glycerin, triethanolamine, an anionic detergent and a nonionic detergent. The silicate content determines the amount of anionic and/or nonionic detergent in the liquid cleaning composition. However, the foaming property of these detergent compositions is not discussed therein.

U.S. Pat. No. 4,129,515 discloses a heavy duty liquid detergent for laundering fabrics comprising a mixture of substantially equal amounts of anionic and nonionic surfactants alkanolamines and magnesium salts, and, optionally, zwitterionic surfactants as suds modifiers.

U.S. Pat. No. 4,224,195 discloses an aqueous detergent composition for laundering socks or stockings comprising a specific group of nonionic detergents, namely, an ethylene oxide of a secondary alcohol, a specific group of anionic detergents, namely, a sulfuric acid ester salt of an ethylene oxide adduct of a secondary alcohol, and an amphoteric surfactant which may be a betaine, wherein either the anionic or nonionic surfactant may be the major ingredient. The specific class of anionics utilized in this patent is the very same group of anionic detergents expressly excluded in present invention in order to eliminate the alkanol ethoxylate sulfation process and the potential dioxane toxicity problem. Furthermore, this patent finds heavily foaming detergents undesirable for the purpose of washing socks.

The prior art also discloses detergent compositions containing all nonionic surfactants as shown in U.S. Pat. Nos. 4,154,706 and 4,329,336 wherein the shampoo compositions contain a plurality of particular nonionic surfactants in order to effect desirable foaming and detersive properties despite the fact that nonionic surfactants are usually deficient in such properties.

SUMMARY OF THE INVENTION

It has now been found that a liquid detergent composition can be formulated with an amine oxide surfactant which has desirable cleaning properties and improved color stability.

Accordingly, one object of the invention is to provide a light duty liquid detergent compositions containing amine oxide which has improved color stability having improved skin feel properties.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention, as embodied and broadly described herein the light duty liquid detergent of this invention having improved color stability comprises an amine oxide, the pentasodium salt of diethylene triamine pentaacetic acid, equimolar amount of a reducing agent such as sodium bisulfite or an enzyme to reduce residual free peroxides in the amine oxide and water and optionally at least one second surfactant selected from the group consisting of an alkyl monoalkanol amide, a water soluble, ethoxylated, nonionic surfactant, an anionic surfactant selected from the group consisting of water soluble organic sulfates and organic sulfonates, a water soluble, zwitterionic surfactant selected from the class of betaines, an alkyl polyglucoside surfactant, alkyl succinamate surfactant and a cationic surfactant, wherein the composition does not contain any inorganic detergent builder salts or hydroxy ethylene diamine tetraacetic acid.

DETAILED DESCRIPTION OF THE INVENTION

The present invention relates to a light duty liquid composition which, optionally, can be in a microemulsion form comprising approximately by weight:

(a) 0.1% to 30%, more preferably 0.5% to 20% of an amine oxide;

(b) 0 to 40%, more preferably 0.1% to 30% of at least one second surfactant selected from the group consisting of ethoxylated nonionic surfactants, anionic surfactants containing a sulfate group, a carboxylic group or a sulfonate group, an alkyl monoalkanol amide, an alkyl dialkanol amide, a zwitterionic surfactant, an alkyl polyglucoside surfactant, a cationic surfactant and an alkyl succinamate surfactant;

(c) 0 to 15%, more preferably 0. 1% to 12% of a water soluble cosurfactant;

(d) 0 to 15%, more preferably 0.1% to 10% of a solubilizing agent;

(e) 0 to 10%, more preferably 0.1% to 9% and most preferably 0.4% to 8% of a perfume, essential oil or water insoluble organic compound containing about 6 to about 20 carbon atoms;

(f) 0.01% to 1% of a penta sodium salt of diethylene triamine pentaacetic acid; and (g) 0 to 0.2% of a reducing agent such as sodium bisulfite;

(h) the balance being water, wherein the composition does not contain any hydroxy ethylene diamine tetraacetic acid (HEDTA), an ethylene diamine tetraacetic acid. Also excluded from the instant compositions are heteroatom containing alkyl aldonamide compound, hair conditioning agents such as long chain esters, lanolin, polyols and oils, and also excluded from the instant composition are water-insoluble condition particles having an average diameter of from about 10 microns to about 500 microns, said particles comprising an amine-organic anion ion-pair complex having the formula:

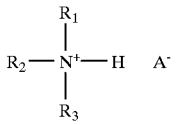

wherein each $R_1$ and $R_2$ can independently be $C_{12}$–$C_{20}$ alkyl or alkenyl, each $R_3$ is H or $CH_3$, and A is an organic anionic selected from the group consisting of aryl sulfonates, alkylaryl sulfonates comprising a $C_1$–$C_5$ alkyl, dialkyl sulfosuccinates, alkyl oxybenzene sulfonates, acyl isethionates, acylalkyl taurates, alkyl ethoxylated sulfates and olefin sulfonates and mixtures of said ion-pair complexes.

The water soluble nonionic surfactants which may be utilized in this invention are commercially well known and include the primary aliphatic alcohol ethoxylates, secondary aliphatic alcohol ethoxylates, alkylphenol ethoxylates and ethylene-oxide-propylene oxide condensates on primary alkanols, such a Plurafacs™ (BASF) and condensates of ethylene oxide with sorbitan fatty acid esters such as the Tweens™ (ICI). The nonionic synthetic organic detergents generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water-soluble nonionic detergent. Further, the length of the polyethoxy chain can be adjusted to achieve the desired balance between the hydrophobic and hydrophilic elements.

The nonionic surfactant class includes the condensation products of a higher alcohol (e.g., an alkanol containing 8 to 18 carbon atoms in a straight or branched chain configuration) condensed with 5 to 30 moles of ethylene oxide, for example, lauryl or myristyl alcohol condensed with 16 moles of ethylene oxide (EO), tridecanol condensed with 6 to moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to 14 carbon atoms in length and wherein the condensate contains either 6 moles of EO per mole of total alcohol or 9 moles of EO per mole of alcohol and tallow alcohol ethoxylates containing 6 EO to 11 EO per mole of alcohol.

A preferred group of the foregoing nonionic surfactants are the Neodol™ ethoxylates (Shell Co.), which are higher aliphatic, primary alcohols containing about 9–15 carbon atoms, such as $C_9$–$C_{11}$ alkanol condensed with 8 moles of ethylene oxide (Neodol 91-8)™, $C_{12-13}$ alkanol condensed with 6.5 moles ethylene oxide (Neodol 23-6.5)™, $C_{12-15}$ alkanol condensed with 12 moles ethylene oxide (Neodol 25-12)™, $C_{14-15}$ alkanol condensed with 13 moles ethylene oxide (Neodol 45-13)™, and the like. Such ethoxamers have an HLB (hydrophobic lipophilic balance) value of 8–15 and give good/W emulsification, whereas ethoxamers with HLB values below 8 contain less than 5 ethyleneoxy groups and tend to be poor emulsifiers and poor detergents.

Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type are $C_{11-C15}$ secondary alkanol condensed with either 9 EO (Tergitol 15-S-9)™ or 12 EO (Tergitol 15-S-12)™ marketed by Union Carbide.

Other suitable nonionic surfactants include the polyethylene oxide condensates of one mole of alkyl phenol containing from 8 to 18 carbon atoms in a straight- or branched chain alkyl group with 5 to 30 moles of ethylene oxide. Specific examples of alkyl phenol ethoxylates include nonyl condensed with 9.5 moles of EO per mole of nonyl phenol, dinonyl phenol condensed with 12 moles of EO per mole of phenol, dinonyl phenol condensed with 15 moles of EO per mole of phenol and di-isoctylphenol condensed with 15 moles of EO per mole of phenol. Commercially available nonionic surfactants of this type include Igepal CO-630™ (nonyl phenol ethoxylate) marketed by GAF Corporation.

Also among the satisfactory nonionic surfactants are the water-soluble condensation products of a $C_8$–$C_{20}$ alkanol with a heteric mixture of ethylene oxide and propylene oxide wherein the weight ratio of ethylene oxide to propylene oxide is from 2.5:1 to 4:1, preferably 2.8:1–3.3:1, with the total of the ethylene oxide and propylene oxide (including the terminal ethanol or propanol group) being from 60–85%, preferably 70–80%, by weight. Such surfactants are commercially available from BASF-Wyandotte and a particularly preferred detergent is a $C_{10}$–$C_{16}$ alkanol condensate with ethylene oxide and propylene oxide, the weight ratio of ethylene oxide to propylene oxide being 3:1 and the total alkoxy content being 75% by weight.

Other suitable water-soluble nonionic surfactants which are less preferred are marketed under the trade name "Pluronics™." The compounds are formed by condensing ethylene oxide with a hydrophobic base formed by the condensation of propylene oxide with propylene glycol. The molecular weight of the hydrophobic portion of the molecule is of the order of 950 to 4000 and preferably 200 to 2,500. The addition of polyoxyethylene radicals to the hydrophobic portion tends to increase the solubility of the molecule as a whole so as to make the surfactant water-soluble. The molecular weight of the block polymers vary from 1,000 to 15,000 and the polyethylene oxide content may comprise 20% to 80% by weight. Preferably, these surfactants will be in liquid form and satisfactory surfactants are available as grades L62 and L64.

The anionic surfactants which may be used in the composition of this invention are water soluble such as triethanolamine and include the sodium, potassium, ammonium and ethanolammonium salts of $C_8$–$C_{20}$ fatty acid, $C_8$–$C_{18}$ alkyl sulfates such as lauryl sulfate, myristyl sulfate and the like; $C_{8-18}$ ethoxylated alkyl ether sulfates; linear $C_8$–$C_{16}$ alkyl benzene sulfonates; $C_{10}$–$C_{20}$ paraffin sulfonates and alpha olefin sulfonates containing about 10–24 carbon atoms.

The $C_{8-18}$ ethoxylated alkyl ether sulfate surfactants which may be used in the instant composition have the structure:

$$R—(OCH_2CH_2)_nOSO_3^-M^+$$

wherein n is about 1 to about 22, more preferably 1 to 3, and R is an alkyl group having about 8 to about 18 carbon atoms, more preferably 12 to 15, and natural cuts, for example, $C_{12-14}$; $C_{12-15}$ and M is an ammonium cation or an alkali metal cation, most preferably sodium or ammonium.

The ethoxylated alkyl ether sulfate may be made by sulfating the condensation product of ethylene oxide and $C_{8-10}$ alkanol, and neutralizing the resultant product. The ethoxylated alkyl ether sulfates differ from one another in the number of carbon atoms in the alcohols and in the number of moles of ethylene oxide reacted with one mole of such alcohol. Preferred ethoxylated alkyl ether polyethenoxy sulfates contain 12 to 15 carbon atoms in the alcohols and in the alkyl groups thereof, e.g., sodium myristyl (3 EO) sulfate.

Ethoxylated $C_{8-18}$ alkylphenyl ether sulfates containing from 2 to 6 moles of ethylene oxide in the molecule are also suitable for use in the invention compositions. These detergents can be prepared by reacting an alkyl phenol with 2 to 6 moles of ethylene oxide and sulfating and neutralizing the resultant ethoxylated alkylphenol. The concentration of the ethoxylated alkyl ether sulfate surfactant is about 1 to about 8 wt. %.

The magnesium salt of the sulfonate surfactant are the well known higher alkyl mononuclear aromatic sulfonates such as the higher alkyl benzene sulfonates containing from 10 to 16 carbon atoms in the higher alkyl group in a straight or branched chain, $C_8$–$C_{15}$ alkyl toluene sulfonates and $C_8$–$C_{15}$ alkyl phenol sulfonates.

A preferred sulfonate is linear alkyl benzene sulfonate having a high content of 3- (or higher) phenyl isomers and a correspondingly low content (well below 50%) of 2- (or lower) phenyl isomers, that is, wherein the benzene ring is preferably attached in large part at the 3 or higher (for example, 4, 5, 6 or 7) position of the alkyl group and the content of the isomers in which the benzene ring is attached in the 2 or 1 position is correspondingly low. Particularly preferred materials are set forth in U.S. Pat. No. 3,320,174.

The zwitterionic surfactant which may be used is a water soluble betaine having the general formula:

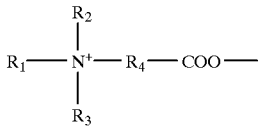

wherein $R_1$ is an alkyl group having 10 to 20 carbon atoms, preferably 12 to 16 carbon atoms, or the amido radical:

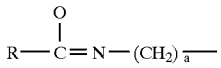

wherein R is an alkyl group having 9 to 19 carbon atoms and a is the integer 1 to 4; $R_2$ and $R_3$ are each alkyl groups having 1 to 3 carbons and preferably 1 carbon; $R_4$ is an alkylene or hydroxyalkylene group having from 1 to 4 carbon atoms and, optionally, one hydroxyl group. Typical alkyldimethyl betaines include decyl dimethyl betaine or 2-(N-decyl-N, N-dimethyl-ammonia) acetate, coco dimethyl betaine or 2-(N-coco N, N-dimethylammonio) acetate, myristyl dimethyl betaine, palmityl dimethyl betaine, lauryl diemethyl betaine, cetyl dimethyl betaine, stearyl dimethyl betaine, etc. The amidobetaines similarly include cocoamidoethylbetaine, cocoamidopropyl betaine and the like. A preferred betaine is coco ($C_8$–$C_{18}$) amidopropyl dimethyl betaine.

The alkyl succinamate which may be used is used in the composition is depicted by the formula:

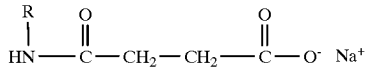

wherein R is a $C_8$ to $C_{18}$ alkyl group.

The instant composition can optionally contain a $C_{12-14}$ alkyl monoalkanol amide such as lauryl monoalkanol amide and/or a $C_{12-14}$ alkyl dialkanol amide such as lauryl diethanol amide or coco diethanol amide.

The alkyl polysaccharides surfactants, which may be used have a hydrophobic group containing from about 8 to about 20 carbon atoms, preferably from about 10 to about 16 carbon atoms, most preferably from about 12 to about 14 carbon atoms, and polysaccharide hydrophilic group containing from about 1.5 to about 10, preferably from about 1.5 to about 4, most preferably from about 1.6 to about 2.7 saccharide units (e.g., galactoside, glucoside, fructoside, glucosyl, fructosyl; and/or galactosyl units). Mixtures of saccharide moieties may be used in the alkyl polysaccharide surfactants. The number x indicates the number of saccharide units in a particular alkyl polysaccharide surfactant. For a particular alkyl polysaccharide molecule x can only assume integral values. In any physical sample of alkyl polysaccharide surfactants there will be in general molecules having different x values. The physical sample can be characterized by the average value of x and this average value can assume non-integral values. In this specification the values of x are to be understood to be average values. The hydrophobic group (R) can be attached at the 2-, 3-, or 4- positions rather than at the 1-position, (thus giving e.g. a glucosyl or galactosyl as opposed to a glucoside or galactoside). However, attachment through the 1- position, i.e., glucosides, galactoside, fructosides, etc., is preferred. In the preferred product the additional saccharide units are predominately attached to the previous saccharide unit's 2-position. Attachment through the 3-, 4-, and 6- positions can also occur. Optionally and less desirably there can be a polyalkoxide chain joining the hydrophobic moiety (R) and the polysaccharide chain. The preferred alkoxide moiety is ethoxide.

Typical hydrophobic groups include alkyl groups, either saturated or unsaturated, branched or unbranched containing from about 8 to about 20, preferably from about 10 to about 18 carbon atoms. Preferably, the alkyl group is a straight chain saturated alkyl group. The alkyl group can contain up to 3 hydroxy groups and/or the polyalkoxide chain can contain up to about 30, preferably less than about 10, alkoxide moieties.

Suitable alkyl polysaccharides are decyl, dodecyl, tetradecyl, pentadecyl, hexadecyl, and octadecyl, di-, tri-, tetra-, penta-, and hexaglucosides, galactosides, lactosides, fructosides, fructosyls, lactosyls, glucosyls and/or galactosyls and mixtures thereof.

The alkyl monosaccharides are relatively less soluble in water than the higher alkyl polysaccharides. When used in admixture with alkyl polysaccharides, the alkyl monosaccharides are solubilized to some extent. The use of alkyl monosaccharides in admixture with alkyl polysaccharides is a preferred mode of carrying out the invention. Suitable mixtures include coconut alkyl, di-, tri-, tetra-, and penta-glucosides and tallow alkyl tetra-, penta-, and hexaglucosides.

The preferred alkyl polysaccharides are alkyl polyglucosides having the formula $$R_2O\ (C_nH_{2n}O)r(Z)_x$$

wherein Z is derived from glucose, $R_2$ is a hydrophobic group selected from the group consisting of alkyl, alkylphenyl, hydroxyalkylphenyl, and mixtures thereof in which said alkyl groups contain from about 10 to about 18, preferably from about 12 to about 14 carbon atoms; n is 2 or 3 preferably 2, r is from 0 to 10, preferable 0; and x is from 1.5 to 8, preferably from 1.5 to 4, most preferably from 1.6 to 2.7. To prepare these compounds a long chain alcohol ($R_2OH$) can be reacted with glucose, in the presence of an acid catalyst to form the desired glucoside. Alternatively the alkyl polyglucosides can be prepared by a two step procedure in which a short chain alcohol ($R_1OH$) can be reacted with glucose, in the presence of an acid catalyst to form the desired glucoside. Alternatively the alkyl polyglucosides can be prepared by a two step procedure in which a short chain alcohol ($C_{1-6}$) is reacted with glucose or a polyglucoside (x=2 to 4) to yield a short chain alkyl glucoside (x=1 to 4) which can in turn be reacted with a longer chain alcohol ($R_2OH$) to displace the short chain alcohol and obtain the desired alkyl polyglucoside. If this two step procedure is used, the short chain alkylglucosde content of the final alkyl polyglucoside material should be less than 50%, preferably less than 10%, more preferably less than about 5%, most preferably 0% of the alkyl polyglucoside.

The amount of unreacted alcohol (the free fatty alcohol content) in the desired alkyl polysaccharide surfactant is preferably less than about 2%, more preferably less than about 0.5% by weight of the total of the alkyl polysaccharide. For some uses it is desirable to have the alkyl monosaccharide content less than about 10%.

The used herein, "alkyl polysaccharide surfactant" is intended to represent both the preferred glucose and galactose derived surfactants and the less preferred alkyl polysaccharide surfactants. Throughout this specification, "alkyl polyglucoside" is used to include alkyl polyglycosides because the stereochemistry of the saccharide moiety is changed during the preparation reaction.

An especially preferred APG glycoside surfactant is APG 625™ glycoside manufactured by the Henkel Corporation of Ambler, PA. APG 625™ is a nonionic alkyl polyglycoside characterized by the formula:

$$C_nH_{2n+1}O(C_6H_{10}O_5)_xH$$

wherein n=10 (2%); n=122 (65%); n=14 (21–28%); n=16 (4–8%) and n=18 (0.5%) and x (degree of polymerization)= 1.6. APG 625 has: a pH of 6 to 10 (10% of APG 625™ in distilled water); a specific gravity at 25° C. of 1.1 g/ml; a density at 25° C. of 9.1 lbs/gallon; a calculated HLB of 12.1 and a Brookfield viscosity at 35° C., 21 spindle, 5–10 RPM of 3,000 to 7,000 cps.

Amine oxide semi-polar nonionic surfactants used in the instant compositions comprise compounds and mixtures of compounds having the formula

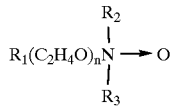

wherein $R_1$ is an alkyl, 2-hydroxyalkyl, 3-hydroxyalkyl, or 3-alkoxy-2-hydroxypropyl radical in which the alkyl and alkoxy, respectively, contain from 8 to 18 carbon atoms, $R_2$ and $R_3$ are each methyl, ethyl, propyl, isopropyl, 2-hydroxyethyl, 2-hydroxypropyl, or 3-hydroxypropyl, and n is from 0 to 10. Particularly preferred are amine oxides of the formula:

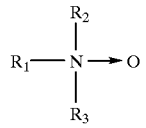

wherein $R_1$ is a $C_{12-16}$ alkyl, or cocoamidopropyl group and $R_2$ and $R_3$ are methyl or ethyl. The above ethylene oxide condensates, amides, and amine oxides are more fully described in U.S. Pat. No. 4,316,824 which is hereby incorporated herein by reference. Preferred amine oxides are lauryl amine oxide and cocoamido propyl amine oxide. The concentration of the amine oxide in the instant compositions is 3 to 12 wt. %, more preferably 4 to 10 wt. %.

To the composition can also be added a solubilizing agent which can be water soluble hydrotropic salts include sodium, potassium, ammonium and mono-, di- and triethanolammonium salts of xylene sulfonate or cumene sulfonate a $C_1$ to $C_4$ alkanol such as ethanol and/or urea. Preferably the solubilizing ingredient will be a mixture of ethanol and either sodium xylene sulfonate or sodium cumene sulfonate or a mixture of said sulfonates or ethanol and urea. Inorganic salts such as sodium sulfate, magnesium sulfate, sodium chloride and sodium citrate can be added at concentrations of 0.5 to 4.0 wt. % to modify the cloud point of the nonionic surfactant and thereby control the haze of the resultant solution. Various other ingredients such as urea at a concentration of 0.5 to 4.0 wt. % or urea at the same concentration in combination with ethanol at a concentration of 0.5 to 4.0 wt. % can be used as solubilizing agents.

When the composition is in the microemulsion form the concentration of the water soluble cosurfactant is about 0.1 wt. % to about 12 wt. % and the concentration of the perfume, essential oil or water insoluble organic compound having about 6 to about 20 carbon atoms such as a hydrocarbon is about 0.4 wt. % to about 8 wt. %.

As used herein and in the appended claims the term "perfume" is used in its ordinary sense to refer to and include any non-water soluble fragrant substance or mixture of substances including natural (i.e., obtained by extraction of flower, herb, blossom or plant), artificial (i.e., mixture of natural oils or oil constituents) and synthetically produced substance) odoriferous substances. Typically, perfumes are complex mixtures of blends of various organic compounds such as alcohols, aldehydes, ethers, aromatic compounds and varying amounts of essential oils (e.g., terpenes) such as from 0% to 80%, usually from 10% to 70% by weight, the essential oils themselves being volatile odoriferous compounds and also serving to dissolve the other components of the perfume.

In the present invention the precise composition of the perfume is of no particular consequence to cleaning performance so long as it meets the criteria of water immiscibility and having a pleasing odor. Naturally, of course, especially for cleaning compositions intended for use in the home, the perfume, as well as all other ingredients, should be cosmetically acceptable, i.e., non-toxic, hypoallergenic, etc. The instant compositions show a marked improvement in ecotoxocity as compared to existing commercial products.

The hydrocarbon such as a perfume is present in the microemulsion in an amount of from 0.4% to 8% by weight, preferably from 0.4% to 4.0% by weight. If the amount of hydrocarbon (perfume) is less than 0.4% by weight it becomes difficult to form the o/w microemulsion.

Furthermore, although superior grease removal performance will be achieved for perfume compositions not containing any terpene solvents, it is apparently difficult for perfumers to formulate sufficiently inexpensive perfume compositions for products of this type (i.e., very cost sensitive consumer-type products) which includes less than 20%, usually less than 30%, of such terpene solvents.

Thus, merely as a practical matter, based on economic consideration, the dilute microemulsion detergent cleaning compositions of the present invention may often include as much as 0.2% to 7% by weight, based on the total composition, of terpene solvents introduced thereunto via the perfume component. However, even when the amount of terpene solvent in the cleaning formulation is less than 1.5% by weight, such as up to 0.6% by weight or 0.4% by weight or less, satisfactory grease removal and oil removal capacity is provided by the inventive diluted o/w microemulsions.

Thus, for a typical formulation of a microemulsion according to this invention a 20 milliliter sample of microemulsion containing 1% by weight of perfume will be able to solubilize, for example, up to 2 to 3 ml of greasy and/or oily soil, while retaining its form as a microemulsion, regardless of whether the perfume contains 0%, 0.1%, 0.2%, 0.3%, 0.4%, 0.5%, 0.6%, 0.7% or 0.8% by weight of terpene solvent. In other words, it is an essential feature of the compositions of this invention that grease removal is a function of the result of the microemulsion, per se, and not of the presence or absence in the microemulsion of a "greasy soil removal" type of solvent.

In place of the perfume in the microemulsion composition at the same previously defined concentrations that the perfume was used in either the microemulsion or the all purpose hard surface cleaning composition one can employ an essential oil or a water insoluble hydrocarbon having 6 to 18 carbon such as a paraffin or isoparaffin.

Suitable essential oils are selected from the group consisting of: Anethole 20/21 natural, Aniseed oil china star, Aniseed oil globe brand, Balsam (Peru), Basil oil (India), Black pepper oil, Black pepper oleoresin 40/20, Bois de Rose (Brazil) FOB, Borneol Flakes (China), Camphor oil, White, Camphor powder synthetic technical, Cananga oil (Java), Cardamom oil, Cassia oil (China), Cedarwood oil (China) BP, Cinnamon bark oil, Cinnamon leaf oil, Citronella oil, Clove bud oil, Clove leaf, Coriander (Russia), Coumarin 69° C. (China), Cyclamen Aldehyde, Diphenyl oxide, Ethyl vanilin, Eucalyptol, Eucalyptus oil, Eucalyptus citriodora, Fennel oil, Geranium oil, Ginger oil, Ginger oleoresin (India), White grapefruit oil, Guaiacwood oil, Gurjun balsam, Heliotropin, Isobornyl acetate, Isolongifolene, Juniper berry oil, L-methyl acetate, Lavender oil, Lemon oil, Lemongrass oil, Lime oil distilled, Litsea Cubeba oil, Longifolene, Menthol crystals, Methyl cedryl ketone, Methyl chavicol, Methyl salicylate, Musk ambrette, Musk ketone, Musk xylol, Nutmeg oil, Orange oil, Patchouli oil, Peppermint oil, Phenyl ethyl alcohol, Pimento berry oil, Pimento leaf oil, Rosalin, Sandalwood oil, Sandenol, Sage oil, Clary sage, Sassafras oil, Spearmint oil, Spike lavender, Tagetes, Tea tree oil, Vanilin, Vetyver oil (Java) and Wintergreen.

A major class of compounds found to provide highly suitable water soluble cosurfactants for the microemulsion over temperature ranges extending from 5° C. to 43° C. for instance are glycerol, ethylene glycol, water-soluble polyethylene glycols having a molecular weight of 300 to 1000, polypropylene glycol of the formula $HO((CH_3)CHCH_2O)_nH$ wherein n is a number from 2 to 18, mixtures of polyethylene glycol and polypropylene glycol (Synalox)™ and mono $C_1$–$C_6$ alkyl ethers and esters of ethylene glycol and propylene glycol having the structural formulas $R(X)_nOH$ and $R_1(X)_nOH$ wherein R is $C_1$–$C_6$ alkyl group, $R_1$ is $C_{2-C4}$ acyl group, X is $(OCH_2CH_2)$ or $(OCH2(CH_3)CH)$ and n is a number from 1 to 4, diethylene glycol, triethylene glycol, an alkyl lactate, wherein the alkyl group has 1 to 6 carbon atoms, 1-methoxy-2-propanol, 1methoxy-3-propanol, and 1methoxy 2-, 3- or 4-butanol.

Representative members of the polypropylene glycol include dipropylene glycol and polypropylene glycol having a molecular weight of 200 to 1000, e.g., polypropylene glycol 400. Other satisfactory glycol ethers are ethylene glycol monobutyl ether (butyl cellosolve), diethylene glycol monobutyl ether (butyl carbitol), triethylene glycol monobutyl ether, mono, di, tri propylene glycol monobutyl ether, tetraethylene glycol monobutyl ether, mono, di, tripropylene glycol monomethyl ether, propylene glycol monomethyl ether, ethylene glycol monohexyl ether, diethylene glycol monohexyl ether, propylene glycol tertiary butyl ether, ethylene glycol monoethyl ether, ethylene glycol monomethyl ether, ethylene glycol monopropyl ether, ethylene glycol monopentyl ether, diethylene glycol monomethyl ether, diethylene glycol monoethyl ether, diethylene glycol monopropyl ether, diethylene glycol monopentyl ether, triethylene glycol monomethyl ether, triethylene glycol monoethyl ether, triethylene glycol monopropyl ether, triethylene glycol monopentyl ether, triethylene glycol monohexyl ether, mono, di, tripropylene glycol monoethyl ether, mono, di tripropylene glycol monopropyl ether, mono, di, tripropylene glycol monopentyl ether, mono, di, tripropylene glycol monohexyl ether, mono, di, tributylene glycol mono methyl ether, mono, di, tributylene glycol monoethyl ether, mono, di, tributylene glycol monopropyl ether, mono, di, tributylene glycol monobutyl ether, mono, di, tributylene glycol monopentyl ether and mono, di, tributylene glycol monohexyl ether, ethylene glycol monoacetate and dipropylene glycol propionate.

The present liquid detergents such as dishwashing liquids are readily made by simple mixing methods from readily available components which, on storage, do not adversely affect the entire composition.

The following examples are merely illustrative of the invention and are not to be construed as limiting thereof.

EXAMPLE 1

The following compositions were evaluated visually for color stability upon aging. Samples were aged at room temperature and 120° F. for various time periods. Proportions are % by weight of the total compositions. The scale used for color assessment was 1=clear, 5=yellow, 10=dark.

| Ingredients | A | B |
|---|---|---|
| AO | 32 | 32 |
| HEDTA | 1.0 | |
| DTPA | | 1.0 |
| Water | 67 | 67 |
| Visual color Assessment | | |
| Initial | 2 | 2 |
| 3 weeks 120° F. | 8 | 4 |
| 12 weeks 120° F. | 10 | 4 |

AO - Amine oxide
DTPA - Diethylene triamine pentaacetic acid
HEDTA - Hydroxy ethylene diamine tetraacetic acid

EXAMPLE 2

The following compositions were evaluated visually for color stability upon aging. Samples were aged at room temperature and 120° F. for various time periods. Proportions are % by weight of the total compositions.

| Ingredients | A | B |
|---|---|---|
| AO | 6 | 6 |
| Na/Mg LAS | 12 | 12 |
| AEOS | 12 | 12 |
| APG 625 | 6 | 6 |
| Hydrotrope | 1.2 | 1.2 |
| Alcohol | 2.5 | 2.5 |
| Sodium chloride | 1 | 1 |
| Sodium bisulfite | 0.075 | 0.075 |
| Preservative, color, fragrance | <2 | <2 |
| HEDTA | 0.08 | |
| DTPA | | 0.12 |
| Water | balance | balance |
| Initial | | |
| pH | 6.9 | 6.9 |
| Viscosity (Brookfield viscometer at 25° C., spindle 21, 20 RPMs) cps | 460 | 460 |
| Visual Color Assessment | clear | clear |
| 13 weeks 110° F. | | |
| pH | 8.1 | 7.3 |
| Viscosity (Brookfield viscometer at 25° C., spindle 21, 20 RPMs) cps | 325 | 403 |
| Visual Color Assessment | dark brown | yellow |

What is claimed is:

1. A liquid detergent composition comprising by weight:

(a) 0.1% to 30% of an amine oxide surfactant;

(b) 0.01% to 1% of penta sodium salt of diethylene triamine penta-acetic acid; 0.075% to 0.2% of a reducing agent which is sodium bisulfite; (d) 0.1% to 30% of a second surfactant selected from the group consisting of ethoxylated nonionic surfactants, an alkyl monoalkanol amide, an alkyl dialkanol amide, a zwitterionic surfactant, an alkyl polyglucoside surfactant, a cationic surfactant and an alkyl succinamate surfactant;

(c) the balance being water; wherein the composition does not contain any hydroxy ethylene diamine tetwaacetic acid; an ethylene diamine tetraacetic acid; heteroatom containing alkyl aldonamide compounds; hair conditioning agents which contain long chain esters, lanolin, polyols, and oils; water-insoluble condition particles having an average diameter of from about 10 microns to about 500 microns, said particles comprising an amine-organic anion pair complex having the formula:

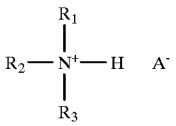

wherein each $R_1$ and $R_2$ can independently be $C_{12}$–$C_{20}$ alkyl or alkenyl, each $R_3$ is H or $CH_3$, and A is an organic anionic selected from the group consisting of aryl sulfonates, alkylaryl sulfonates comprising a $C_1$–$C_5$ alkyl, dialkyl sulfosuccinates, alkyl oxybenzene sulfonates, acyl isethionates, acylalkyl taurates, alkyl ethoxylated sulfates and olefin sulfonates and mixtures of said ion-pair complexes.

2. A liquid detergent composition according to claim 1 further including 0.1 wt. % to 10.0 wt. % of a solubilizing agent.

3. A liquid detergent composition according to claim 1 further including 0.1 wt. % to 12 wt. % of a water soluble cosurfactant and 0.4 wt. % to 8 wt. % of a perfume, essential oil or water insoluble hydrocarbon having about 6 to about 20 carbon atoms.

* * * * *